United States Patent [19]

Frischbier

[11] 3,947,259

[45] Mar. 30, 1976

[54] THERMODYNAMICALLY IMPROVED SYSTEM FOR PRODUCING GASEOUS OXYGEN AND GASEOUS NITROGEN

[75] Inventor: Klaus Frischbier, Munich, Germany

[73] Assignee: Linde Aktiengesellschaft, Wiesbaden, Germany

[22] Filed: July 10, 1974

[21] Appl. No.: 487,130

[30] Foreign Application Priority Data

July 10, 1973 Germany ..... 2335096

[52] U.S. Cl. ..... 62/13; 62/30; 60/38

[51] Int. Cl.[2] ..... F25J 5/00

[58] Field of Search ..... 62/27–31, 38, 62/39, 9, 11, 23, 24, 32–34, 36, 42, 43

[56] References Cited

UNITED STATES PATENTS 3,066,494 12/1962 Potts ..... 62/29

R19,267 8/1934 VanNuys ..... 62/38

*Primary Examiner*—Wilbur L. Bascomb, Jr.
*Assistant Examiner*—Frank Sever
*Attorney, Agent, or Firm*—Millen, Raptes & White

[57] ABSTRACT

A process for producing gaseous oxygen and gaseous nitrogen by the low-temperature rectification of air in a double rectification column having a low-pressure section and a high-pressure section, comprising warming a process stream in a cold section of a reversible heat exchange zone against entering air and thereupon engine-expanding resultant warmed process stream, the improvement wherein a portion is branched off from the warmed process stream prior to its expansion, which portion is liquefield in a condenser-evaporator of the double rectifying column, is subcooled, and is then expanded into the low-pressure section (7) of the double rectifying column (8).

17 Claims, 2 Drawing Figures

THERMODYNAMICALLY IMPROVED SYSTEM FOR PRODUCING GASEOUS OXYGEN AND GASEOUS NITROGEN

BACKGROUND OF THE INVENTION

This invention relates in general to a cryogenic separation system, and in particular to a process and apparatus for obtaining gaseous oxygen and gaseous nitrogen by the low-temperature rectification of air in a double rectification column, wherein a process stream is warmed in the cold section of a reversible heat exchange unit against entering air and is thereafter engine-expanded.

Processes for the separation of air by means of low-temperature rectification are known wherein the raw air is cooled, in reversible heat exchangers, such as, for example, regenerators or "Revex", against gaseous separation products, freed of water vapor and carbon dioxide, and fed, after partial liquefaction, into the high-pressure column of a double rectification column. An air fraction withdrawn from the high-pressure column is warmed in the cold section of the heat exchangers and, after engine expansion, introduced into the low-pressure column of the double column.

Thus, according to the conventional practice, the removal of the water vapor and carbon dioxide from the raw air requires the recycling and/or warming of a process stream (e.g., an air fraction from the high-pressure column) in the cold section of the heat exchangers. To obtain a complete purification of the air, this process stream (also called the compensating stream) must amount to about 11–13% of the amount of the total air throughput. Deviations from this range result in unstable reversing ratios and finally in carbon dioxide accumulations in the liquid oxygen pool in the condenser-evaporator of the low-pressure column. Carbon dioxide obstructions diminish the heat exchange efficiency and promote the formation of sites of explosion in the condenser-evaporators due to local enrichment of hydrocarbons on account of the dry evaporation of the oxygen in the evaporator passages obstructed by carbon dioxide.

During normal operation of the evaporator-condensor with passages not obstructed by carbon dioxide an internal liquid oxygen circulation is formed, the oxygen stream traversing the passages in upward direction. The rate of evaporation from the circulating liquid oxgyen usually amounts to no more than about 20 to 40%. Hydrocarbons contained in the liquid oxygen remain in the liquid phase. Carbon dioxide obstructions diminish the flow cross section of the passages, thereby increasing the resistance of flow and reducing the liquid oxygen circulation to an amount where all liquid introduced is evaporated (dry evaporation), the hydrocarbons contained in the liquid oxygen being deposited during evaporation on the inner walls of the passages.

The compensating stream is customarily engine-expanded in a turbine after giving off its cold to the entering raw air. The thus-obtained refrigeration serves for covering all refrigeration losses of the process. In air separation plants of certain sizes where all separation products are produced in the gaseous phase at ambient temperature, the expansion of the compensating stream generates a significantly larger quantity of cold than actually required by the process. This excess becomes greater with increased plant size, as the larger the plant, the smaller the specific insulating losses. For example, whereas about 20–25% of the employed air must be expanded in the turbine to cover the refrigeration requirement in smaller plants, the expansion of no more than 7% in most cases is sufficient in modern large-scale plants.

Since on the one hand, the compensating stream must not drop below 11–13% of the air throughout but, on the other hand, an expansion of 7% of the employed air is entirely sufficient, excess cold is produced by the engine expansion of the compensating stream. Thus, additional energy must be expended to convert the liquid oxygen, externally of the process, from the liquid phase into a gaseous phase at ambient temperature. In other words, energy is required to remove the excess cold. In order to save this additional vaporizing energy, the compensating stream is, under practical conditions, engine-expanded in the turbine, but only after the inlet pressure is first lowered to such an extent that the remaining pressure expansion in the turbine yields precisely the required amount of cold. However, such a mode of operation is still extremely unsatisfactory due to the high thermodynamic energy losses incurred thereby.

SUMMARY OF THE INVENTION

This invention is based on the problem of developing a process of the aforedescribed type which does not exhibit the above-discussed disadvantages and wherein especially the existing discrepancy between the compensating stream and the turbine stream to be expanded is eliminated in air separation plants with reversible heat exchange devices, while simultaneously increasing the oxygen yield.

This problem is solved by providing that a portion is branched off from the warmed process stream before its expansion, is liquefied in a condenser-evaporator of the double rectifying column, and, after subcooling, is expanded into the low-pressure section of the double rectifying column.

Despite the throttling of the compensating stream before the engine expansion thereof, as heretofore effected in practice, an amount of excess cold remains resulting in a constant increase of the liquid in the condenser of the double rectifying column and requiring the withdrawal of liquid. However, by the heat introduced according to this invention into the zone of the column by means of the branched-off portion of the process stream, not subjected to engine expansion, the balance can be compensated for, since this gas stream has a higher heat content than the engine-expanded portion. This additional heating value provided to the condenser-evaporator of the double rectifying column effects an increase in the reflux ratio in the low-pressure column, so that, with the same number of plates, a higher oxygen yield is attained.

The oxygen yield of the process can be increased very considerably by the particular use of gaseous nitrogen from the high-pressure section of the double rectifying column as the process stream, since the branched-off and liquefied nitrogen has the effect of a scrubbing liquid in the low-pressure column.

In order to further reduce the excess of cold in the column exchange area, it is very advantageous, in case nitrogen is used as the compensating or process stream, to cool the engine-expanded portion of the process stream and the portion thereof which is to be liquefied against nitrogen from the low-pressure section of the double rectifying column, and to warm the engine-expanded and cooled partial stream against entering raw air. On the one hand, refrigeration is withdrawn thereby from the very cold nitrogen coming from the column exchange area, thus cooling the portion to be liquefied in the condenser-evaporator advantageously to the dew point temperature, and, on the other hand, the engine-expanded partial stream is removed from the plant as pure nitrogen at ambient temperature.

In addition to using nitrogen as the process or compensating stream, there is the possibility of employing an air stream, whereby it is possible to omit the heat exchanger cooling the engine-expanded partial stream against nitrogen coming from the low-pressure column. With the use of air, two modifications are available. The process stream utilized can be an oxygen-enriched air fraction from the high-pressure section of the double rectifying column, or it can be a portion of the air cooled to the dew point temperature. In both cases, the procedure is advantageous insofar as the engine-expanded protion of the process stream is directly introduced into the low-pressure section of the double rectifying column, thereby eliminating a heat exchanger. The compensating stream (process stream) amounts to about 11 to 13% of the amount of the total air throughput. The percentage of the compensating gas which is expanded amounts to about 6 to 7% in big plants and to about 8 to 9% in small ones, the percentage of the compensating gas being branched off and condensed amounts to about 5 to 6% and 3 to 4% respectively (in proportion to the total air throughput). These values are independent of the particular kind of gas (nitrogen or air) employed as the compensating stream.

An apparatus for conducting the process comprises a double rectifying column, subdivided by an assembly of multiple condenser-evaporator units into a high-pressure section and a low-pressure section, wherein one condenser-evaporator unit is separated from the remaining units and provided with conduits extending through the wall of the double rectifying column. The separation of the condenser-evaporator units is necessary, since the portion of the process stream to be liquefied has a lower pressure, due to flowing through several heat exchangers, than the gaseous mixture in the high pressure column.

Due to this lower pressure, this condenser-evaporator unit operates at a smaller average temperature difference as compared to the other condenser-evaporator units; for this reason, the present invention has the further feature that the condenser-evaporator unit provided with the conduits has a relatively larger heat-exchange area than the remaining units.

BRIEF DESCRIPTION OF THE DRAWINGS

Additional details of the invention will be explained in greater detail with reference to the preferred embodiments schematically illustrated in the figures, to wit.

For the sake of clarity, corresponding components bear the same reference numerals in the two figures.

DETAILED DESCRIPTION OF PREFERRED EMBODIMENTS

Figure 1:
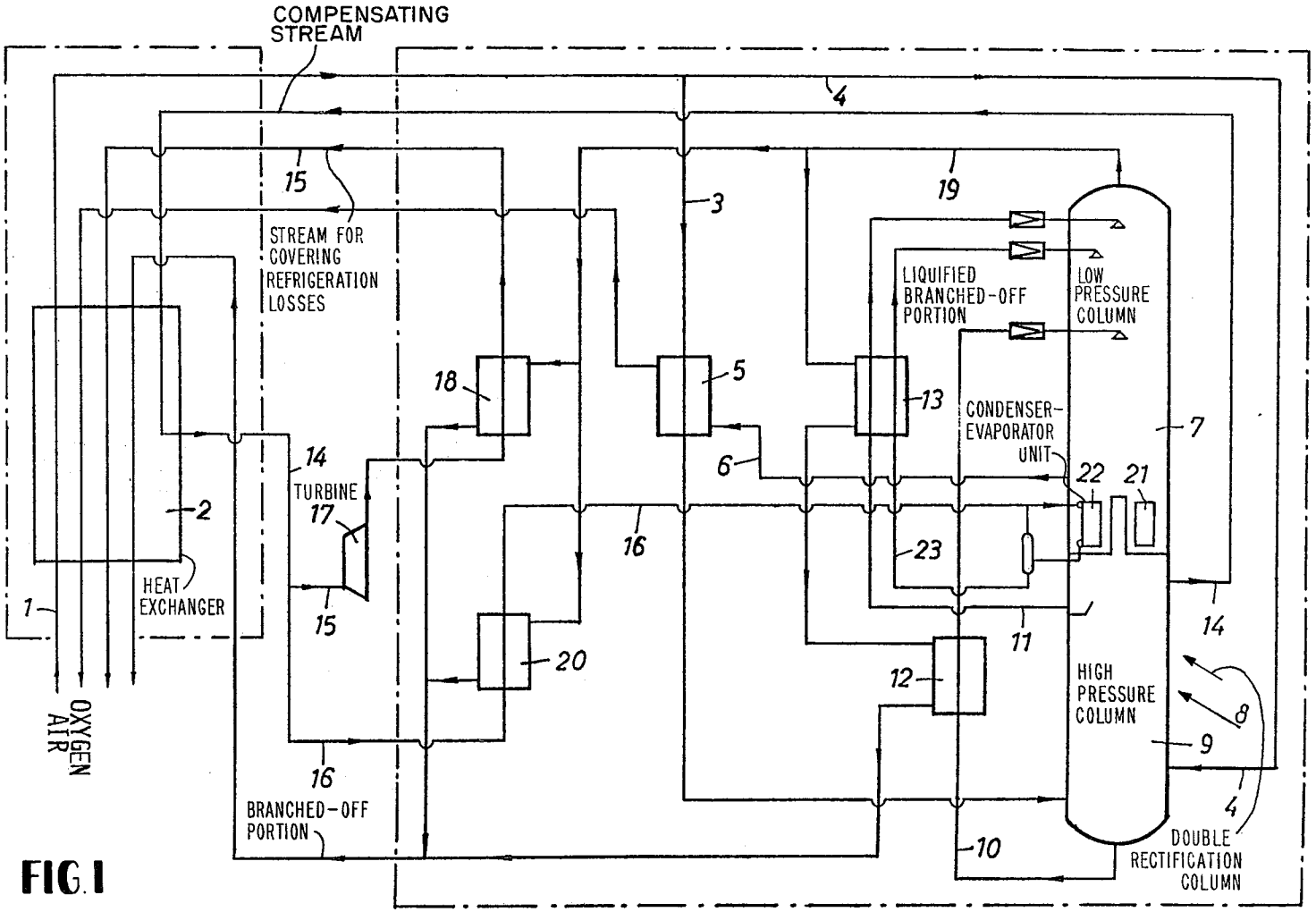
FIG. 1 shows the process of this invention when using nitrogen as the process stream.

According to FIG. 1, air compressed to about 6 atmospheres absolute enters, via a conduit 1, a reversible heat exchanger 2, for example a regenerator, where the air is cooled against separation products, thus freed of carbon dioxide and water vapor, and thereafter divided into two partial streams 3 and 4. The partial stream 3, amounting to about 0.6 to 1.2%, preferably 0.7 to 0.9% of the total, is cooled to the dew point temperature in a heat exchanger 5 against gaseous oxygen fed via a conduit 6 from the low-pressure column 7 of a double rectifying column 8 which gaseous oxygen is eventually withdrawn from the plant, after being warmed to ambient temperature in the heat exchanger 2. The partial stream is then introduced into the lower portion of the high-pressure column 9 of the double rectifying column 8, while the partial stream 4 enters the high-pressure column 9 at the temperature at which it has left the heat exchanger 2. In the high-pressure column 9, operating at about 70 to 100 psia, an oxygen-enriched liquid fraction is withdrawn via conduit 10 and a liquid nitrogen fraction is removed via conduit 11. These fractions are cooled in heat exchangers 12 and 13, respectively, against nitrogen withdrawn from the heat of the low-pressure column 7, operating at about 18 to 24 pisa, and are thereafter expanded into the low-pressure column 7 as scrubbing liquid.

Via a conduit 14, gaseous nitrogen is withdrawn in the upper zone of the high-pressure column 9 as the process or compensating stream, is warmed in the cold section of the reversible heat exchanger 2 against entering air and, according to the invention, is separated into two partial streams 15 and 16. The partial stream 15, amounting to about 6 to 9%, (see above) of the total is engine-expanded in a turbine 17, thus producing the refrigeration required for the process, initially cooled in a heat exchanger 18 against nitrogen withdrawn via a conduit 19 from the heat of the low-pressure column, and, after warming in the heat exchanger 2 to ambient temperature, is withdrawn as product nitrogen from the plant.

The partial stream 16 branched off upstream of the turbine 17 in accordance with this invention passes, after cooling to the dew point temperature in a heat exchanger 20 against nitrogen from the low-pressure column, into a condenser-evaporator unit 22 separate from a condenserevaporator unit 21, is liquefied therein and, after subcooling in heat exchanger 13 against nitrogen from the low-pressure column 7, is expanded into the latter via a conduit 23. The subdivision of the condenser-evaporator units is necessary, since the nitrogen utilized as the process stream has, due to its passage through the heat exchangers 2 and 20, an absolute pressure which is lower by about 0.5 atmosphere gauge than that of the gaseous mixture in the high-pressure column 9. due to this lower absolute pressure, the condenser-evaporator 22 operates, as compared to the other condenser-evaporators 21, at a smaller average temperature difference, and for this reason it requires a relatively larger exchange area.

Figure 2:
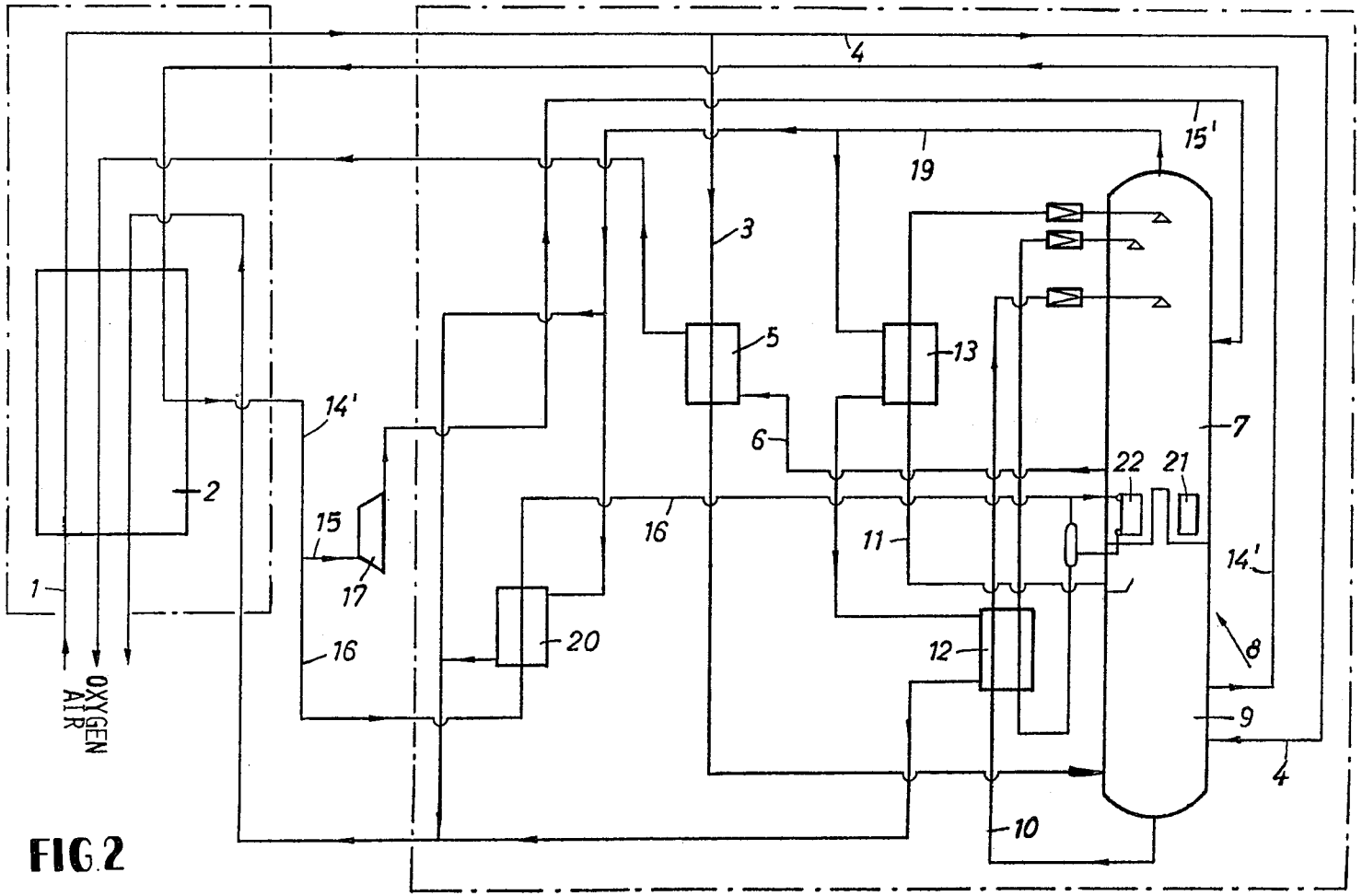
FIG. 2 shows the process of this invention when using an air fraction as the process stream.

The process of FIG. 2 differs from that shown in FIG. 1 in that an air fraction is utilized as the process or compensating stream instead of nitrogen.

An air fraction enriched with gaseous oxygen is withdrawn via a conduit 14′ from the lower zone of the high-pressure column 9, warmed in the cold section of the heat exchanger 2 against entering air, and likewise separated into two partial streams 15 and 16. The partial stream 15 amounting to about 6 to 9%, (see above) of the total is engine-expanded in the turbine 17 to produce refrigeration and then fed, via conduit 15', directly into the middle zone of the low-pressure column 7. The partial stream 16 branched off upstream of the turbine 17 is cooled to the dew point temperature in heat exchange 20 against nitrogen from the low-pressure column 7, liquefied in the condenser-evaporator 22, and subcooled in heat exchanger 12 before it is expanded into the low-pressure column 7.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for producing gaseous oxygen and gaseous nitrogen by the low-temperature rectification of air in a double rectification column having a low-pressure section and a high-pressure section, comprising warming a cold gaseous process stream having a temperature in the range of liquid air in a reversible heat exchanger zone with entering gaseous air to compensate for cold values required for the condensation and removal of $CO_2$ and $H_2O$ from the air, and thereupon engine-expanding resultant warmed process stream, the improvement comprising branching a portion from the resultant warmed process stream prior to engine expansion of said resultant warmed process stream, liquefying said portion substantially completely in a condenser-evaporator unit of the double rectifying column, subcooling resultant liquefied portion to below its liquefaction temperature, and expanding resultant subcooled liquefied portion into the low-pressure section of the double rectification column.

2. A process according to claim 1, wherein gaseous nitrogen from the high-pressure section of the double rectifying column is utilized as the process stream.

3. A process according to claim 2, wherein the engine-expanded portion of the process stream and the portion of the process stream to be liquefied are cooled with nitrogen from the low-pressure section of the double rectifying column and resultant cooled engine-expanded portion of the process stream is warmed against entering raw air.

4. A process according to claim 1, wherein said cold process steam is an air fraction from the high-pressure section of the double rectifying column.

5. A process according to claim 1, wherein said cold process stream is a portion of the air cooled to the dew point temperature.

6. A process according to claim 4, wherein the engine-expanded portion of the process stream is introduced directly into the low-pressure section of the double rectifying column.

7. A process according to claim 5, wherein the engine-expanded portion of the process stream is introduced directly into the low-pressure section of the double rectifying column.

8. A process according to claim 1 wherein the branched-off portion is not recombined with the remainder of the resultant warmed process stream and engine-expanded together with the remainder of the resultant warmed process stream.

9. A process according to claim 1 wherein the liquefied branched-off portion has the same composition as the branched-off portion prior to liquefaction.

10. A process according to claim 8 wherein the liquefied branche-off portion has the same composition as the branched-off portion prior to liquefaction.

11. A process according to claim 1 wherein said branched-off portion is passed into said condenser-evaporator at substantially the same pressure as the pressure of the warmed process stream prior to its expansion.

12. A process according to claim 10 wherein the liquefied branched-off portion has the same composition as the branched-off portion prior to liquefaction.

13. A process according to claim 11 wherein the liquefied branched-off protion has the same composition as the branched-off portion prior to liquefaction.

14. A process according to claim 13 wherein said cold process stream which is warmed in the reversible heat exchange zone amounts to about 11–13% of the total air throughput, and the branched-off portion amounts to 3–6% of the total air throughput.

15. A process according to claim 14 wherein said branched-off portion amounts to about 5–6% of the total air throughput.

16. A process according to claim 1 wherein said cold process stream which is warmed in the reversible heat exchange zone amounts to about 11–13% of the total air throughput, and the branched-off portion amounts to 3–6% of the total air throughput.

17. A process according to claim 1 wherein said branched-off portion amounts to about 5–6% of the total air throughput.

* * * * *